US010327529B2

(12) United States Patent
Bitoh

(10) Patent No.: US 10,327,529 B2
(45) Date of Patent: Jun. 25, 2019

(54) DRAWING DEVICE AND CONTROL METHOD FOR THE SAME

(71) Applicant: CASIO COMPUTER CO., LTD., Shibuya-ku, Tokyo (JP)

(72) Inventor: Hiroyasu Bitoh, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 520 days.

(21) Appl. No.: 15/134,015

(22) Filed: Apr. 20, 2016

(65) Prior Publication Data

US 2016/0374450 A1 Dec. 29, 2016

(30) Foreign Application Priority Data

Jun. 26, 2015 (JP) ..... 2015-128207

(51) Int. Cl.
*A45D 29/22* (2006.01)
*A45D 29/00* (2006.01)

(52) U.S. Cl.
CPC ..... *A45D 29/22* (2013.01); *A45D 29/00* (2013.01); *A45D 2029/005* (2013.01)

(58) Field of Classification Search
CPC ... A45D 29/22; A45D 29/00; A45D 2029/005
See application file for complete search history.

(56) References Cited

U.S. PATENT DOCUMENTS 4,977,891 A * 12/1990 Grim ..... A61F 5/0111 602/27
5,309,365 A 5/1994 Sullivan et al.
5,931,166 A 8/1999 Weber et al.
6,067,996 A 5/2000 Weber et al.
6,336,694 B1 * 1/2002 Ishizaka ..... A45D 29/00 347/105

(Continued)

FOREIGN PATENT DOCUMENTS

CN 203864188 U 10/2014
JP 52125388 9/1977

(Continued)

OTHER PUBLICATIONS

Chinese Office Action dated Jul. 27, 2017 issued in counterpart Chinese Application No. 201610398737.2.

(Continued)

*Primary Examiner* — Heidi M Eide
(74) *Attorney, Agent, or Firm* — Holtz, Holtz & Volek PC

(57) ABSTRACT

A drawing device includes: an insertion portion into which a finger or a toe including a nail which is a drawing target surface is inserted, the insertion portion including an opening configured to expose an entire tip portion of the finger or toe including a region having the nail of the finger or toe; and a holding portion in the insertion portion configured to suppress movement of the finger or toe. The holding portion includes: a first pressing portion opposing a side surface on one side in a width direction of the inserted tip portion of the finger or toe and configured to press the side surface on the one side; and a second pressing portion opposing a side surface on another side in the width direction of the tip portion of the finger or toe and configured to press the side surface on the another side.

11 Claims, 11 Drawing Sheets

(56) References Cited

U.S. PATENT DOCUMENTS

| | | | | |
|---|---|---|---|---|
| 6,525,724 | B1 | 2/2003 | Takami | |
| 8,721,068 | B2 | 5/2014 | Yamasaki | |
| 2009/0101156 | A1 | 4/2009 | Rugfelt | |
| 2012/0147113 | A1* | 6/2012 | Yamasaki | A45D 29/00 347/104 |
| 2014/0267517 | A1 | 9/2014 | Yamasaki | |

FOREIGN PATENT DOCUMENTS

| | | | |
|---|---|---|---|
| JP | 06070810 | A | 3/1994 |
| JP | 2000194838 | A | 7/2000 |
| JP | 3370345 | B2 | 1/2003 |
| JP | 2009536047 | A | 10/2009 |
| JP | 2012135600 | A | 7/2012 |

OTHER PUBLICATIONS

Chinese Office Action (and English language translation thereof) dated Apr. 2, 2018 issued in counterpart Chinese Application No. 201610398737.2.

Japanese Office Action (and English language translation thereof) dated Aug. 7, 2018 issued in counterpart Japanese Application No. 2015-128207.

* cited by examiner

DRAWING DEVICE AND CONTROL METHOD FOR THE SAME

CROSS-REFERENCE TO RELATED APPLICATIONS

This application is based upon and claims the benefit of priority from the prior Japanese Patent Application No. 2015-128207, filed Jun. 26, 2015, the entire contents of which are incorporated herein by reference.

BACKGROUND OF THE INVENTION

1. Field of the Invention

The present invention relates to a drawing device and a control method for the drawing device.

2. Description of the Related Art

As a conventional technique, for example, according to JP 2000-194838 A, a technique is proposed in which a finger having a nail to be drawn is held in a drawing device which draws a nail design on a finger nail.

JP 2000-194838 A discloses a nail art device including a holder for locking a finger. The holder includes an actuation unit on which a finger is placed, and a pair of blade-shaped supporting members interlocking with movement of the actuation unit. When a user places a finger on the actuation unit, and the actuation unit is moved downward, a gap between a pair of the supporting members is reduced, and therefore the finger placed on the actuation unit is held by the pair of the supporting members.

However, the holder according to Patent Literature 1 is for mechanically holding a finger by operating such as the actuation unit and the supporting member. Therefore the holder has a complicated structure and has no concept to softly support the finger.

Therefore, a structure in which a cushion and a spring are arranged on a palm side of a finger inserted into a finger insertion portion, and movement of the finger is suppressed by pressing a portion other than a nail on a nail side (upper side) of the finger against an upper wall of the finger insertion portion by using a reaction force of the cushion and the spring. However, in this structure, a finger can easily move horizontally, and a nail design may not be finely drawn on a nail.

In view of the above state, an object of the present invention is to provide a drawing device and a control method for the drawing device capable of finely drawing a nail design on a nail by suppressing horizontal movement of a finger inserted into a finger insertion portion and certainly holding the finger.

SUMMARY OF THE INVENTION

The present invention is grasped by a configuration to be described below.

According to the present invention, a drawing device and a control method for the drawing device can be provided which can finely draw a nail design on a nail by suppressing horizontal movement of a finger inserted into a finger insertion portion and certainly holding the finger.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DESCRIPTION OF EMBODIMENT

Figure 1:
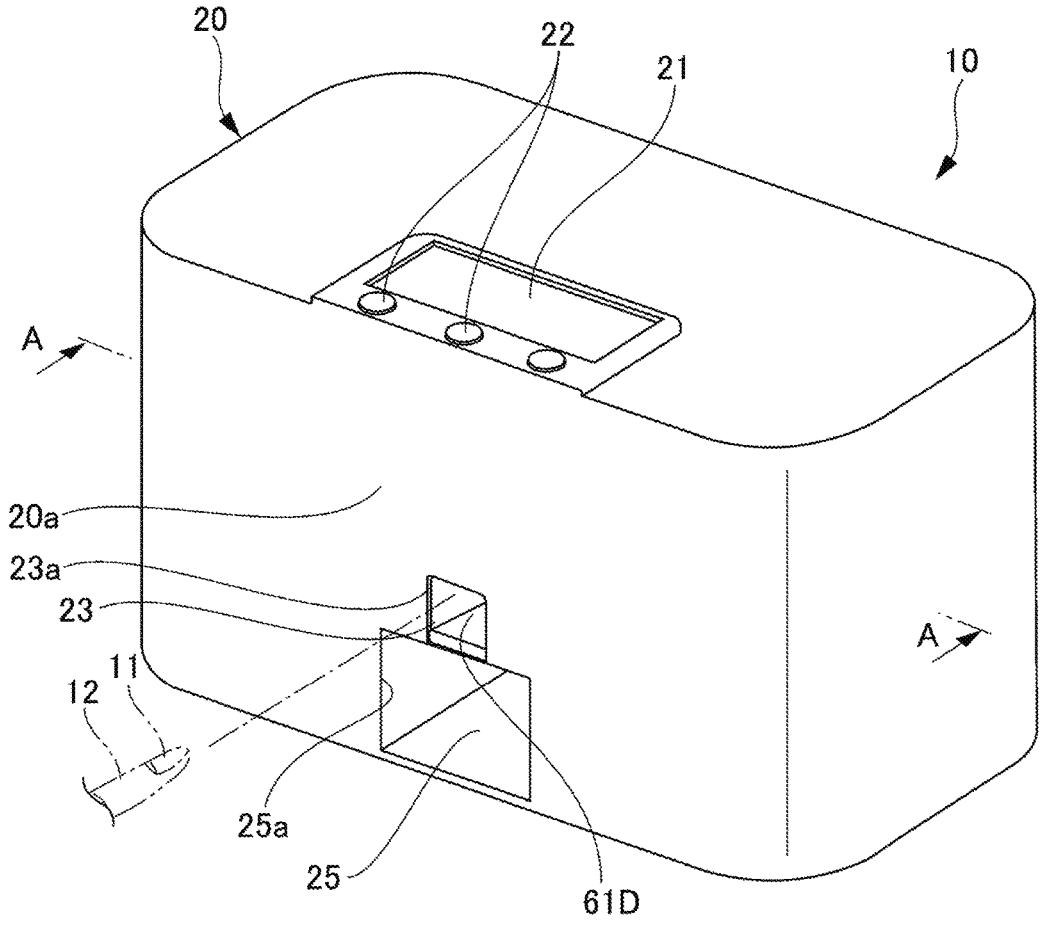
FIG. 1 is a perspective view illustrating an appearance of a drawing device according to an embodiment of the present invention.

With reference to attached drawings, an embodiment according to the present invention (hereinafter called "the embodiment") will be described below. Same elements are denoted by same numbers through the entire description of the embodiment.

In the embodiment to be described below, a drawing device is described as a device which draws on a surface of a finger nail as a drawing target surface. However, the drawing target surface according to the present invention is not limited to the surface of a finger nail. For example, the drawing device draws on a toe nail as a drawing target surface.

(Overall Configuration of Drawing Device)

An embodiment of a drawing device according to the present invention will be described with reference to FIGS. 1 to 5.

As illustrated in FIG. 1, a drawing device 10 has a drawing function and provides a nail design on a nail 11 of user's finger 12. The drawing device 10 includes a box-shaped housing 20, and a display unit 21 and an operation unit 22 are provided on an upper surface (a top plate) of this housing 20. Further an insertion opening 23*a* of a first finger insertion portion 23 is opened at a lower center of a front portion 20*a* of the housing 20. Furthermore, an insertion opening 25*a* of a second finger insertion portion 25 is opened on a lower side of this first finger insertion portion 23. The second finger insertion portion 25 is formed from the front portion 20*a* of the housing 20 toward an inner side in an insertion direction of the finger 12, and the second finger insertion portion 25 is a space into which fingers other than the finger 12 to be drawn of one hand are inserted and also a space partitioned (not communicated) with an inner space of the housing 20.

Figure 2:
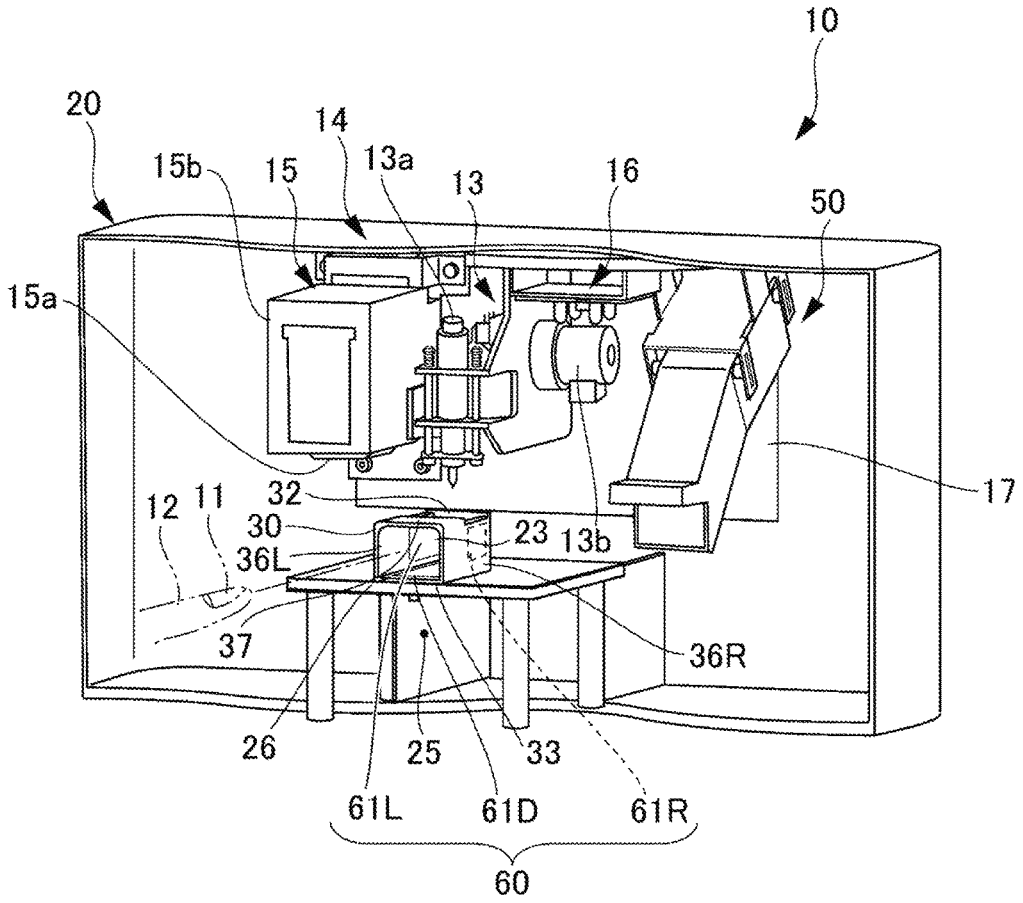
FIG. 2 is a view of a housing cut on A-A line illustrated in FIG. 1.

As illustrated in FIG. 2, a finger placing table 26 is provided on a lower portion in the housing 20, and a finger holding case 30 is provided on an upper surface of the finger placing table 26. The inner space in the finger holding case 30 is a space for forming the first finger insertion portion 23, and a finger holding portion 60 is disposed in the space.

A fixed plate 17 is movably provided in the housing 20 in a device width direction and in a device depth direction. A drawing unit 14 including a pen plotter 13 and an ink jet unit 15 is fixed on one horizontal side (left side in this example) of the fixed plate 17. A dryer 50 for drying ink, applied on the nail 11, by using warm wind is fixed on another horizontal side (right side in this example). Further, an image acquisition unit 16 is provided between the drawing unit 14 and the dryer 50 to recognize a position and a form of the nail 11. FIG. 2 illustrates an inside of the device in the case where the pen plotter 13 is moved right above the opening 32 (to be described later) of the finger holding case 30.

The pen plotter 13 includes a pen 13*a* which performs drawing on the nail 11. The pen plotter 13 can integrally move with the fixed plate 17 in a device width direction and a device depth direction and move up and down by a driving unit 13*b* of such as a stepping motor. After the pen plotter 13 moves right above the opening 32 of the finger holding case 30, a pen tip of the pen 13*a* moved down so as to come into contact with a surface of the nail 11 draws, for example, a base on the surface of the nail 11.

The ink jet unit 15 includes an ink jet head 15*a* and an ink jet cartridge 15*b* and prints a nail design by using the ink jet head 15*a* on the nail 11. The ink jet unit 15 can move integrally with the fixed plate 17 in a device width direction and a device depth direction, and the ink jet unit 15 moves right above the opening 32 of the finger holding case 30 and draws a desired design by using the ink jet head 15*a* on a surface of the nail 11.

Figure 3:
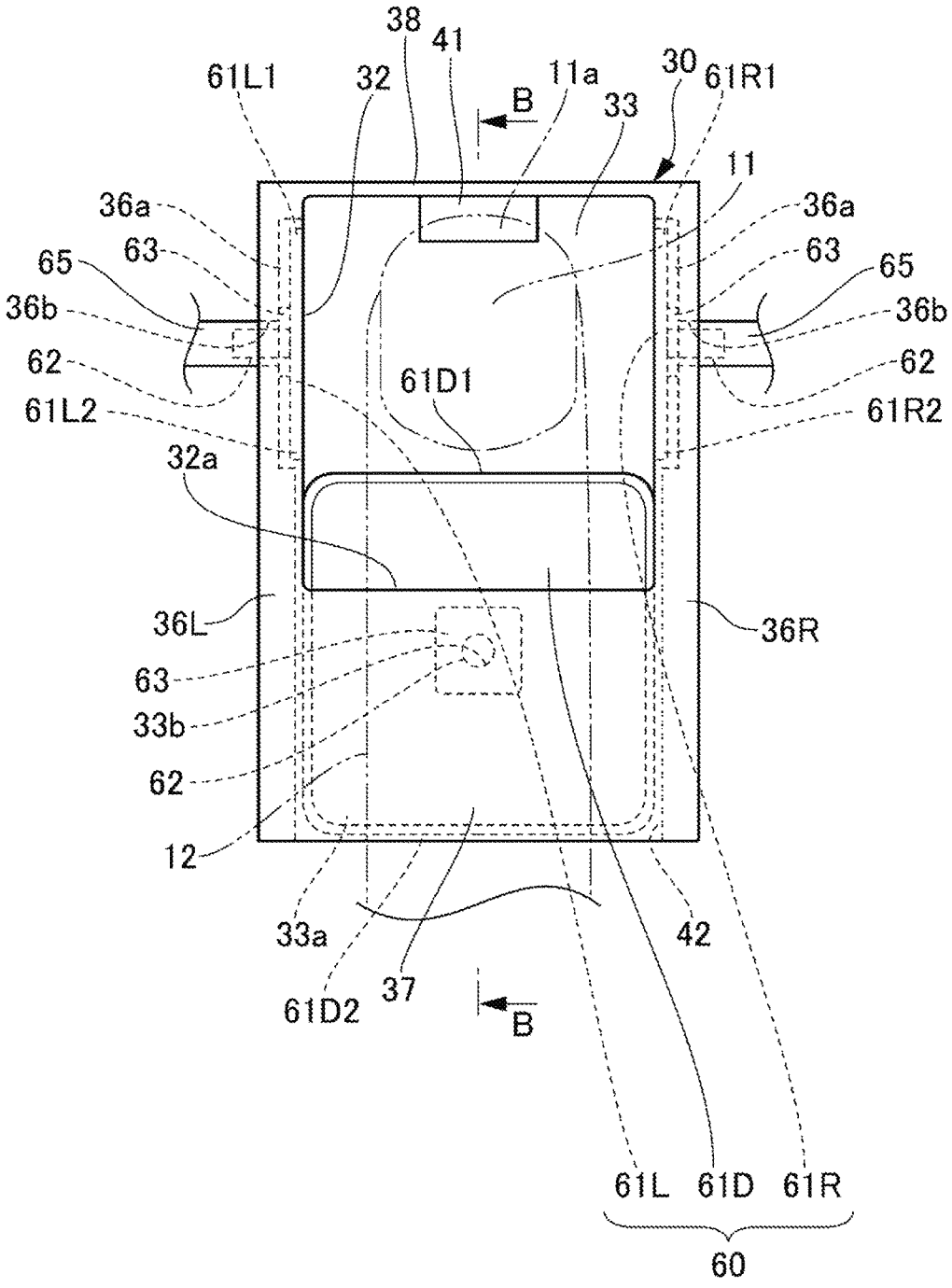
FIG. 3 is a plan view illustrating a structure around a first finger insertion portion according to the embodiment and a view illustrating a state in which a finger holding portion is shrunk.

As illustrated in FIG. 3, the finger holding case 30 is fixed on the finger placing table 26 (refer to FIG. 2), and the finger holding portion 60 is provided therein to suppress movement of a finger.

The finger holding case 30 includes a lower wall 33, right/left side walls 36R and 36L, an upper wall 37, an inner wall 38, and a nail placing table 41. The lower wall 33 is fixed on an upper surface of the finger placing table 26 (refer to FIG. 2). The right/left side walls 36R and 36L are formed on an upper side from each of right and left ends of the lower wall 33. The upper wall 37 is connected to an upper end of the right/left side walls 36R and 36L on a front side in a finger insertion direction (hereinafter simply called "a front side"). The inner wall 38 is connected to an end on a depth side in the finger insertion direction (hereinafter simply called "a depth side") of the right/left side walls 36R and 36L. The nail placing table 41 is erected along an inner surface of the inner wall 38, and a nail tip 11*a* on a tip side of the nail 11 is placed on the nail placing table 41. Further, the opening 32 for exposing an entire tip portion of the finger or the toe including a region having the nail 11 of the inserted finger 12 is formed on an upper portion on a depth side of the finger holding case 30. FIG. 3 illustrates a state in which the nail 11 of the finger 12 inserted into the first finger insertion portion 23 of the finger holding case 30 is visible from an upper side through the opening 32. The tip portion of the finger 12 may include from the tip of the finger 12 to around a distal interphalangeal joint of the finger 12.

Figure 4:
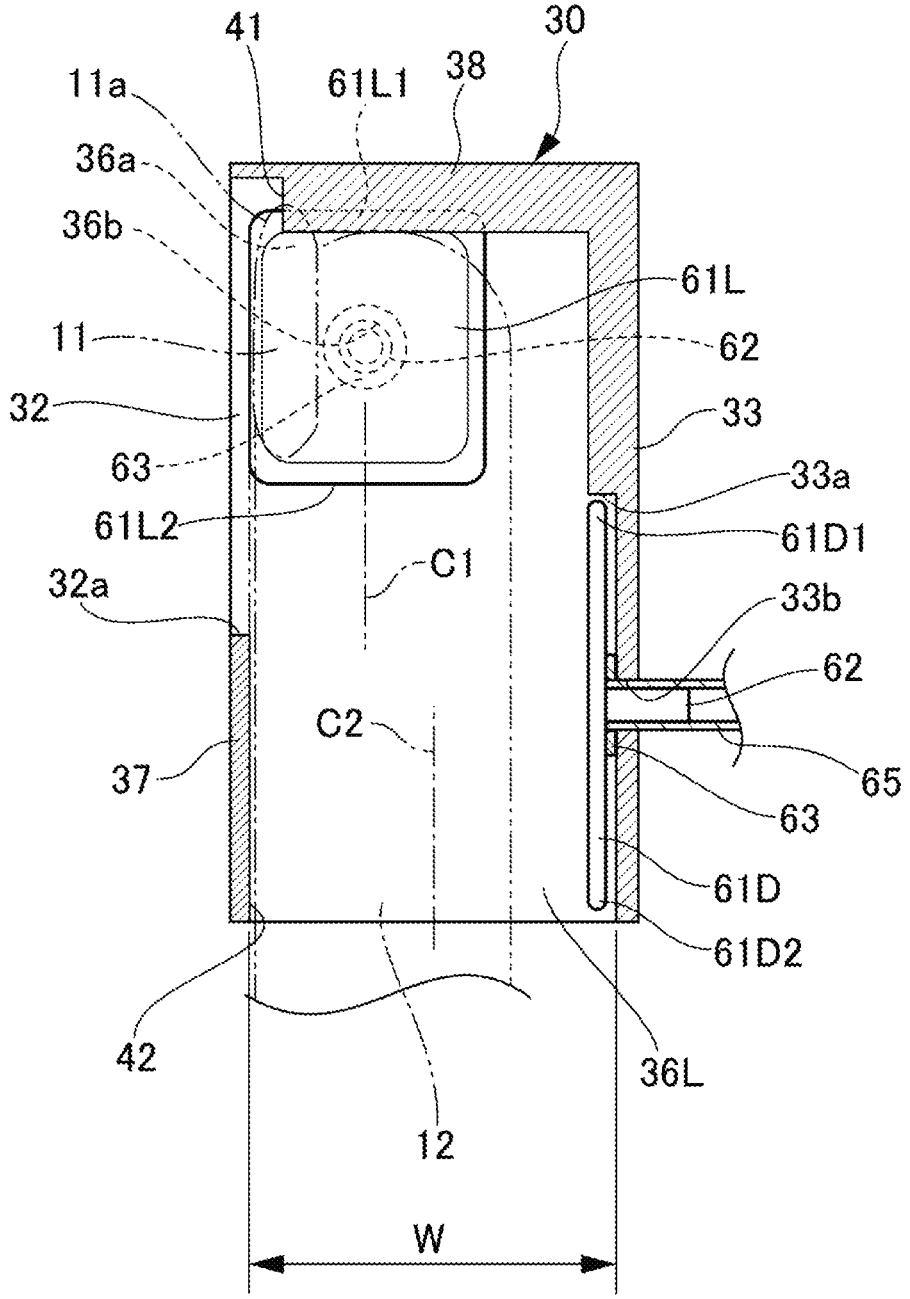
FIG. 4 is a sectional view cut on B-B line illustrated in FIG. 3.

As illustrated in FIG. 4, the lower wall 33 includes a lower-side storage unit 33*a* recessed downward on an inner surface on a front side thereof. A through hole 33*b* is provided at a center of the lower-side storage unit 33*a*. Each of the side walls 36R and 36L includes a side surface storage unit 36*a* recessed sideways on an inner surface on a depth side of the side walls 36R and 36L. The through hole 36*b* is provided at a center of the side surface storage unit 36*a*.

The finger holding portion 60 includes a finger pressing portion disposed on an lower side in the first finger insertion portion 23 (hereinafter called a lower-side finger pressing portion 61D (a third finger pressing portion), a finger pressing portion disposed on a left surface side in the first finger insertion portion 23 (hereinafter called a left-side finger pressing portion 61L (a first finger pressing portion or a second finger pressing portion), and a finger pressing portion disposed on a right surface side in the first finger insertion portion 23 (hereinafter called a right-side finger pressing portion 61R (the second finger pressing portion or the first finger pressing portion) (refer to FIG. 3).

The finger holding portion 60 suppresses movement of the finger 12 by pressing a lower side surface and both side surfaces of the finger 12 by supplying fluid of such as air and inert gas to the three finger pressing portions (the lower-side finger pressing portion 61D, the left-side finger pressing portion 61L, and the right-side finger pressing portion 61R), and also the finger holding portion 60 releases the pressing by discharging the supplied fluid.

(Configuration of Finger Holding Portion)

A configuration of each portion of the finger holding portion 60 and a configuration of a fluid supply/discharge unit 70 for supplying and discharging fluid to the finger holding portion 60 will be described later.

As illustrated in FIG. 4, the lower-side finger pressing portion 61D is formed in a bag shape by a sheet, and for example, appearance thereof is formed in a square shape. In a finger insertion direction of the lower-side finger pressing portion 61D, an end 61D1 on a depth side thereof is positioned on a depth side from an edge 32*a* positioned on a front side of the opening 32, and an end 61D2 on the front side is positioned near a release portion 42 on a front side of the finger holding case 30. A tubular fluid supply/discharge portion 62 is provided on a lower side of the lower-side finger pressing portion 61D. The lower-side finger pressing portion 61D is stored in the lower-side storage unit 33*a* while it is not used (in a state in which the portion is shrunk and flat before being inflated) and bonded to the lower-side storage unit 33*a* by a bonding member 63 (such as a double-sided tape) arranged so as to surround the fluid supply/discharge portion 62. The fluid supply/discharge portion 62 of the lower-side finger pressing portion 61D is inserted into the through hole 33*b* of the lower-side storage unit 33*a*, and the fluid supply/discharge portion 62 is connected to a tube 65 connected to the fluid supply/discharge unit 70 (to be described later).

Returned to FIG. 3. As illustrated in FIG. 3, each of the left-side finger pressing portion 61L and the right-side finger pressing portion 61R is formed in a bag shape by a sheet, and for example, appearance thereof is formed in a square shape.

In the left-side finger pressing portion 61L and the right-side finger pressing portion 61R, ends 61L1 and 61R1 on a depth side of the portions are positioned near the inner wall 38, and the ends 61L2 and 61R2 on a front side are positioned near an end on a depth side of the lower-side finger pressing portion 61D when planarly viewed. The tubular fluid supply/discharge portion 62 is provided on a side surface on an outer side of the left-side finger pressing portion 61L and the right-side finger pressing portion 61R. The left-side finger pressing portion 61L and the right-side finger pressing portion 61R are stored in the right/left side surface storage units 36*a* while those are not used (in a state in which the portions are shrunk and flat before being inflated) and bonded to the side surface storage unit 36*a* by the bonding member 63 (such as a double-sided tape) arranged so as to surround the fluid supply/discharge portion 62. The fluid supply/discharge portions 62 of the left-side finger pressing portion 61L and the right-side finger pressing portion 61R are inserted into the through hole 36*b* of the side surface storage unit 36*a* and connected to the tube 65 connected to the fluid supply/discharge unit 70.

Further, as illustrated in FIG. 4, the side surface storage unit 36*a* is disposed on an upper side on the side walls 36L and 36R, and therefore center portions of the left-side finger pressing portion 61L and the right-side finger pressing portion 61R are positioned on a upper side from a half in a vertical direction width W in the first finger insertion portion 23. Specifically, in the left-side finger pressing portion 61L and the right-side finger pressing portion 61R, a center position C1 in a vertical direction thereof is positioned on an upper side from a center position C2 in the vertical direction of the first finger insertion portion 23.

In the left-side finger pressing portion 61L and the right-side finger pressing portion 61R formed in this manner, at least portions positioned on a depth side are positioned on a depth side from the lower-side finger pressing portion 61D. In this example, the whole of or the substantially whole of the left-side finger pressing portion 61L and the right-side finger pressing portion 61R is disposed on a depth side from the lower-side finger pressing portion 61D.

Examples of constituting materials of the lower-side finger pressing portion 61D, the left-side finger pressing portion 61L, and the right-side finger pressing portion 61R include each type of resin materials such as polyurethane and nylon, and also rubber materials such as elastic nitrile rubber, propylene rubber, silicone rubber, and natural rubber. Further, surfaces of the lower-side finger pressing portion 61D, the left-side finger pressing portion 61L, and the right-side finger pressing portion 61R are covered by elastic cloth. Therefore, texture in the case where the finger 12 comes into contact with the surfaces of the lower-side finger pressing portion 61D, the left-side finger pressing portion 61L, and the right-side finger pressing portion 61R is improved.

Figure 5:
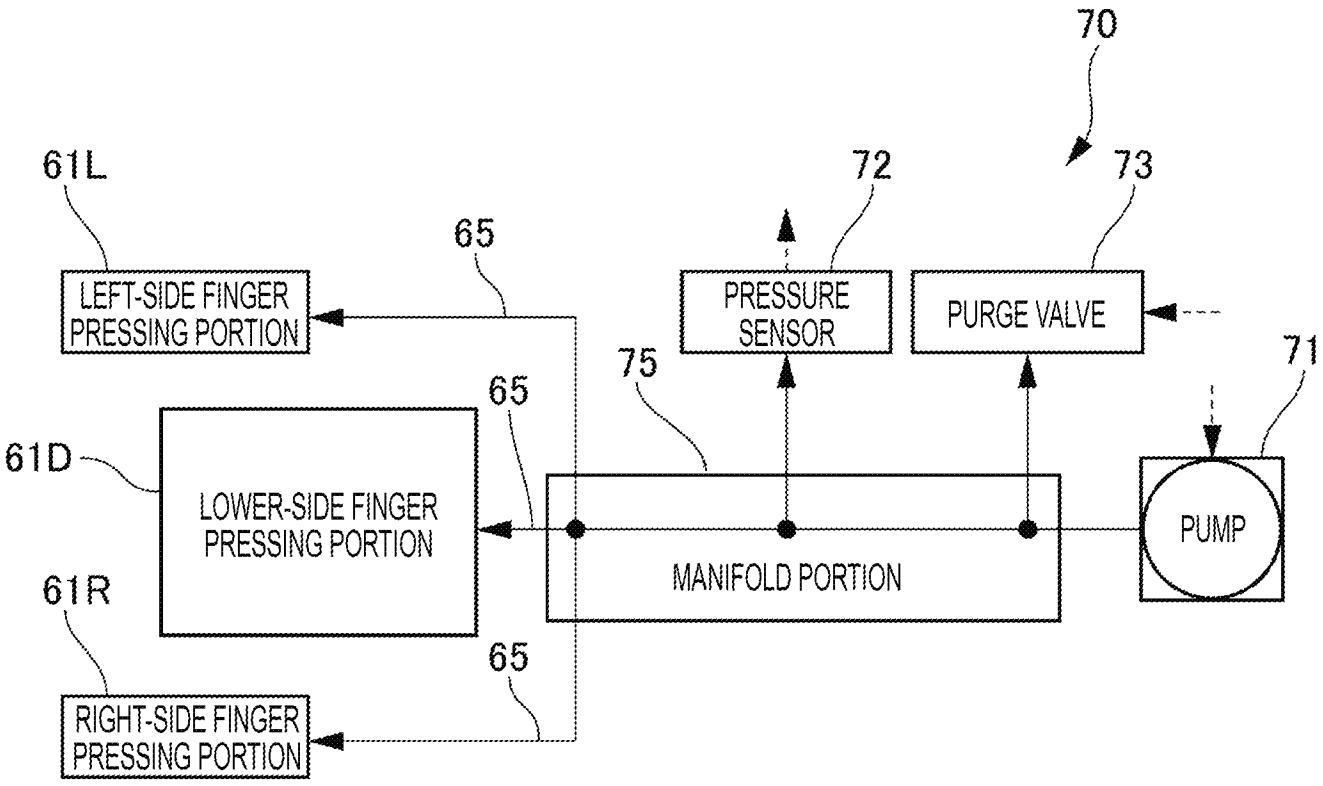
FIG. 5 is a block diagram illustrating a fluid supply/discharge unit according to the embodiment.

As illustrated in FIG. 5, the fluid supply/discharge unit 70 includes a pump 71, a pressure sensor 72, a purge valve 73, and a manifold portion 75. The pump 71 (for example, an air pump) inflates the finger holding portion 60 (the lower-side finger pressing portion 61D, the left-side finger pressing portion 61L, and the right-side finger pressing portion 61R) by supplying fluid thereto. The pressure sensor 72 measures an air pressure in the finger holding portion 60. The purge valve 73 (for example, an electromagnetic valve) is closed when the finger holding portion 60 is inflated and opened to discharge air when the finger holding portion 60 is shrunk. The manifold portion 75 is connected between the finger holding portion 60 and the pump 71, and branches fluid toward the lower-side finger pressing portion 61D, the left-side finger pressing portion 61L, and the right-side finger pressing portion 61R.

In the embodiment, by using the manifold portion 75, the fluid supply/discharge unit 70 to the finger holding portion 60 (the lower-side finger pressing portion 61D, the left-side finger pressing portion 61L, and the right-side finger pressing portion 61R) is commonly used. Three fluid supply/discharge unit 70 including the pump 71, the purge valve 73, and the pressure sensor 72 may be prepared and provided to each of the lower-side finger pressing portion 61D, the left-side finger pressing portion 61L, and the right-side finger pressing portion 61R.

(Operation of Finger Holding Portion)

Next, operation of the finger holding portion 60 will be described with reference to FIGS. 6 and 7.

Figure 6:
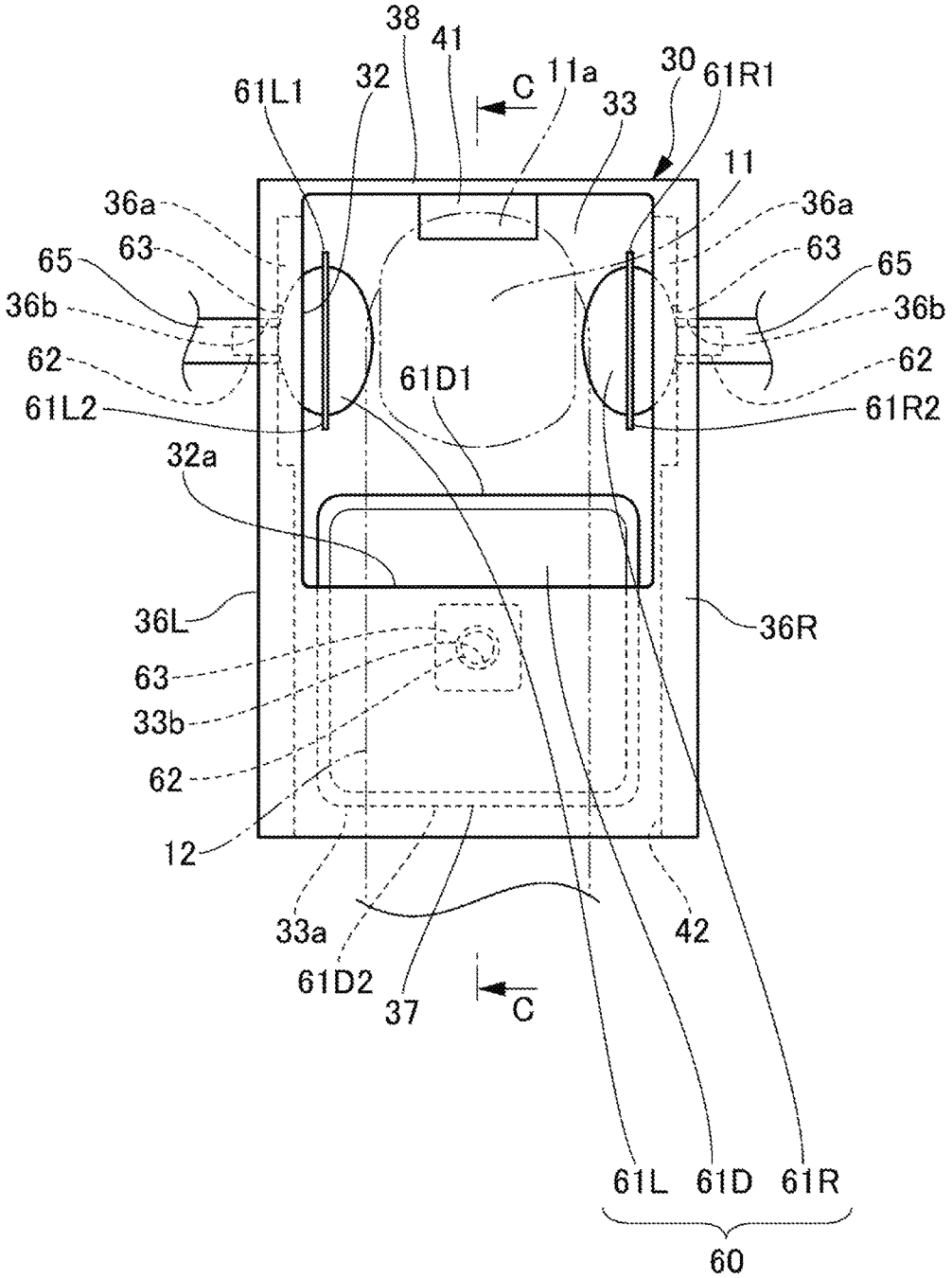
FIG. 6 is a plan view illustrating a structure around the first finger insertion portion according to the embodiment and a view illustrating a state in which the finger holding portion is inflated.
Figure 7:
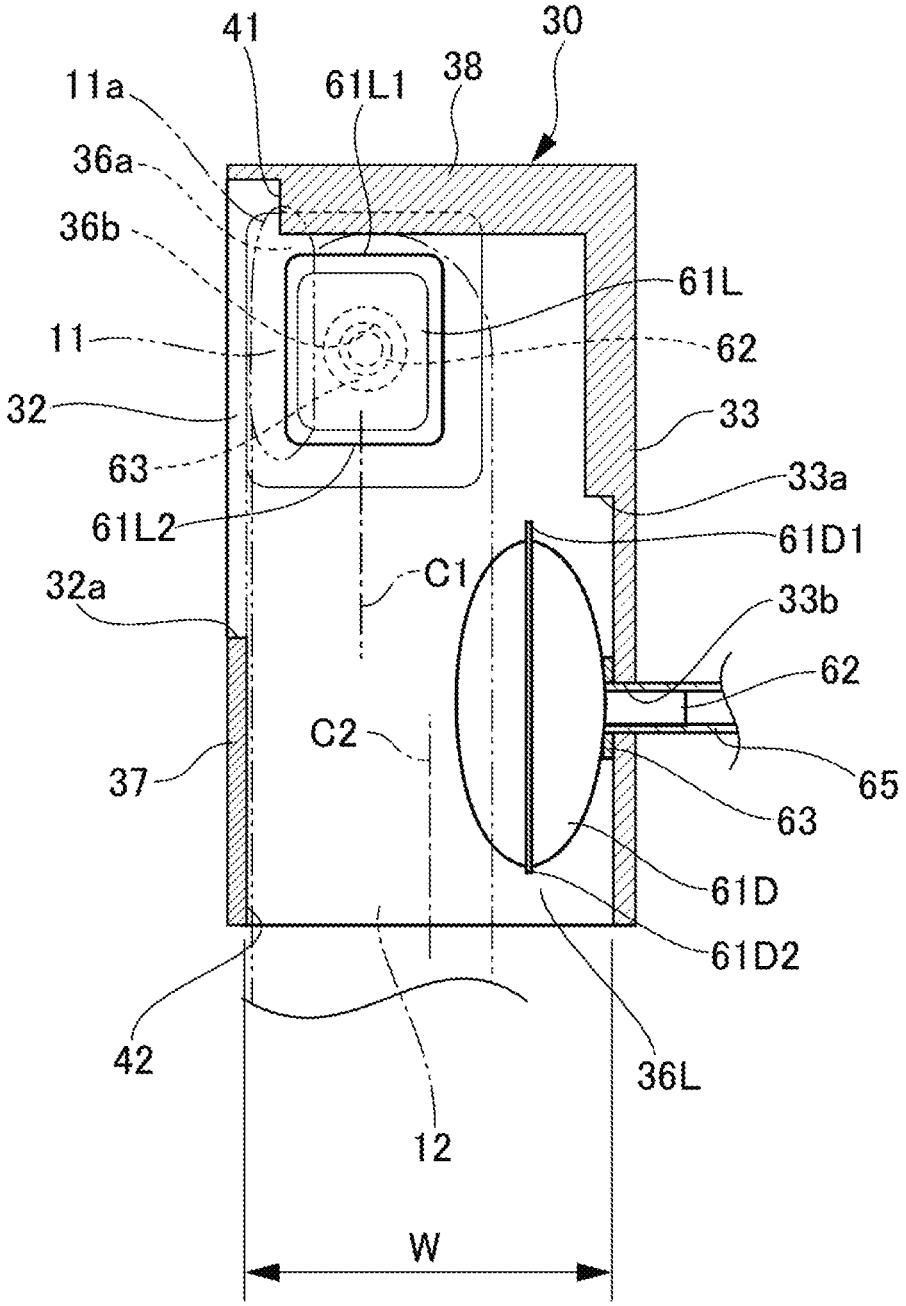
FIG. 7 is a sectional view on C-C line illustrated in FIG. 6.

As illustrated in FIGS. 6 and 7, in a state in which the finger 12 is inserted into the first finger insertion portion 23, and the nail tip 11*a* is placed on the nail placing table 41, the purge valve 73 (refer to FIG. 5) is first closed by energizing the purge valve 73. Next, while the pump 71 (refer to FIG. 5) is energized, and simultaneously the pressure sensor 72 (refer to FIG. 5) measures a pressure, fluid is sent to the lower-side finger pressing portion 61D, the left-side finger pressing portion 61L, and the right-side finger pressing portion 61R via the manifold portion 75 (refer to FIG. 5) and the tube 65. Then, a pressure is applied to the inside of the lower-side finger pressing portion 61D, the left-side finger pressing portion 61L, and the right-side finger pressing portion 61R, and the portions are inflated until the pressure reaches to a desired pressure. When the pressure reaches to the desired pressure, the pump 71 is stopped, and when the pressure is lowered to the desired pressure or less, the pump 71 is driven again to supply fluid until the pressure becomes the desired pressure. Accordingly, the lower-side finger pressing portion 61D, the left-side finger pressing portion 61L, and the right-side finger pressing portion 61R are maintained so as to stably inflate at a desired pressure.

The lower-side finger pressing portion 61D presses a root side portion of the finger 12 so as to push up the portion by stably inflating at a desired pressure and suppresses movement in a vertical direction of the finger 12 by pushing a portion other than the nail 11 on an upper side of the finger 12 against an inner surface of the upper wall 37 (refer to FIG. 7). On the other hand, the left-side finger pressing portion 61L and the right-side finger pressing portion 61R come into contact on horizontal both side surfaces on a tip side of the finger 12 by stably inflating at a desired pressure and suppresses movement in a horizontal direction of the finger 12 by pressing the tip side of the finger 12 so as to sandwich from the horizontal both sides (refer to FIG. 6). Preferably, in a state in which the nail tip 11*a* is placed on the nail placing table 41, movement of a distal interphalangeal joint of the finger 12 which is easily moved and all of movement of the finger 12 in vertical and horizontal directions can be suppressed by pressing at three points of the lower-side finger pressing portion 61D, the left-side finger pressing portion 61L, and the right-side finger pressing portion 61R so as to sandwich a region including the distal interphalangeal joint of the finger 12.

At this time, in the left-side finger pressing portion 61L and the right-side finger pressing portion 61R, the center position C1 in a vertical direction thereof is positioned on an upper side from the center position C2 in a vertical direction of the first finger insertion portion 23. Therefore, on horizontal both side surfaces on a tip side of the finger 12, the tip side of the finger 12 is pressed obliquely downward to press an upper side of the finger 12 in comparison with a vertical center position of the finger 12. Accordingly, it is prevented that the nail 11 is pressed upward and jumped out upward from the opening 32.

As described above, movement of a finger in vertical and horizontal directions is suppressed by the lower-side finger pressing portion 61D, the left-side finger pressing portion 61L, and the right-side finger pressing portion 61R. In a state in which the finger is firmly held in the first finger insertion portion 23, a nail design is drawn on the nail 11 by the pen plotter 13 or the ink jet unit 15 through the opening 32.

When the lower-side finger pressing portion 61D, the left-side finger pressing portion 61L, and the right-side finger pressing portion 61R are shrunk after the nail design has been drawn on the nail 11, the purge valve 73 is opened by cutting energization of the purge valve 73, and the lower-side finger pressing portion 61D, the left-side finger pressing portion 61L, and the right-side finger pressing portion 61R are shrunk and returned to an original flat shape by a restoring force of each of them and stored in the lower-side storage unit 33*a* and the right/left side surface storage units 36*a*. Then, a pressing force to the finger 12 is released.

Effects of Embodiment

According to the embodiment described above, movement in a vertical direction and a horizontal direction of the finger 12 inserted into the first finger insertion portion 23 is suppressed, and the finger 12 is certainly held. Accordingly, a nail design can be finely drawn on the nail 11.

Further, in the embodiment, the left-side finger pressing portion 61L and the right-side finger pressing portion 61R are disposed on a depth side of the first finger insertion portion 23, and the lower-side finger pressing portion 61D is disposed on a front side of the first finger insertion portion 23. If the lower-side finger pressing portion extends to the bottom on the tip side of a finger (right below the nail 11), the tip side of the finger 12 is lifted up on the tip side of the finger 12 by the lower-side finger pressing portion, and the pen 13*a* and the like may come into contact with the nail 11. In this point, according to the embodiment, since the lower-side finger pressing portion 61D is disposed on the front side of the first finger insertion portion 23, the tip side of the finger 12 is lifted up, and it is prevented that the pen 13*a*, the ink jet head 15*a*, and the ink jet cartridge 15*b* come into contact with the nail 11.

On the other hand, the left-side finger pressing portion 61L and the right-side finger pressing portion 61R are positioned on a depth side of the lower-side finger pressing portion 61D, and horizontal movement on a tip side of the finger 12 is stably suppressed. According to the embodiment, almost all of the left-side finger pressing portion 61L and the right-side finger pressing portion 61R are positioned on a depth side from the lower-side finger pressing portion 61D. However, in the left-side finger pressing portion 61L and the right-side finger pressing portion 61R, the portions positioned on the depth side are at least positioned on a depth side from the lower-side finger pressing portion 61D, and accordingly, horizontal movement on the tip side of the finger 12 can be stably suppressed.

Further, according to the embodiment, in the left-side finger pressing portion 61L and the right-side finger pressing portion 61R, the center position C1 in a vertical direction thereof is disposed so as to be positioned on an upper side from the center position C2 in a vertical direction of the first finger insertion portion 23. On the other hand, in the case where the left-side finger pressing portion and the right-side finger pressing portion are disposed on a lower side from a center position in a vertical direction of the finger insertion portion, it is considered that when the left-side finger pressing portion and the right-side finger pressing portion are inflated, a finger is lifted up. In this case, the nail cannot be held at a desired height and may come into contact with such as a pen. In this point, according to the embodiment, the center position C1 in vertical direction of the left-side finger pressing portion 61L and the right-side finger pressing portion 61R presses upper side from the center position in a vertical direction of the finger 12. Therefore, it is further prevented that the finger 12 is pressed sideways or downward and lifted up, and the nail 11 come into contact with such as the pen 13*a*.

Further, the finger holding portion 60 holds the finger 12 by the lower-side finger pressing portion 61D, the left-side finger pressing portion 61L, and the right-side finger pressing portion 61R, which are inflated by fluid. Therefore, in comparison with a conventional holder which mechanically holds a finger by operating an actuation unit and a supporting member, the finger holding portion 60 fits a shape of the finger 12, and a finger holding structure can be provided in which the finger 12 can be softly and certainly held. Further, in comparison with a conventional holder, the finger holding portion 60 has an inexpensive and simple configuration and also can be reduced in size. Furthermore, a finger holding structure, which can be easily mounted, can be provided.

(Variation of Finger Holding Portion)

Next, a first variation of the finger holding portion according to the embodiment will be described with reference to FIGS. 8 to 10.

In the above-described finger holding portion 60 (refer to FIG. 3), the fluid supply/discharge portion 62 is independently provided to each of three finger pressing portions (the lower-side finger pressing portion 61D, the left-side finger pressing portion 61L, and the right-side finger pressing portion 61R) which are individually formed, and each fluid supply/discharge portion 62 is connected to the fluid supply/discharge unit 70 by the tube 65. In addition, in the finger holding portion, the fluid supply/discharge portion may be provided to any one of the lower-side finger pressing portion, the left-side finger pressing portion, and the right-side finger pressing portion, and two finger pressing portions in which the fluid supply/discharge portion is not provided may be connected to the finger pressing portion, in which the fluid supply/discharge portion is provided, via fluid passages.

Figure 8:
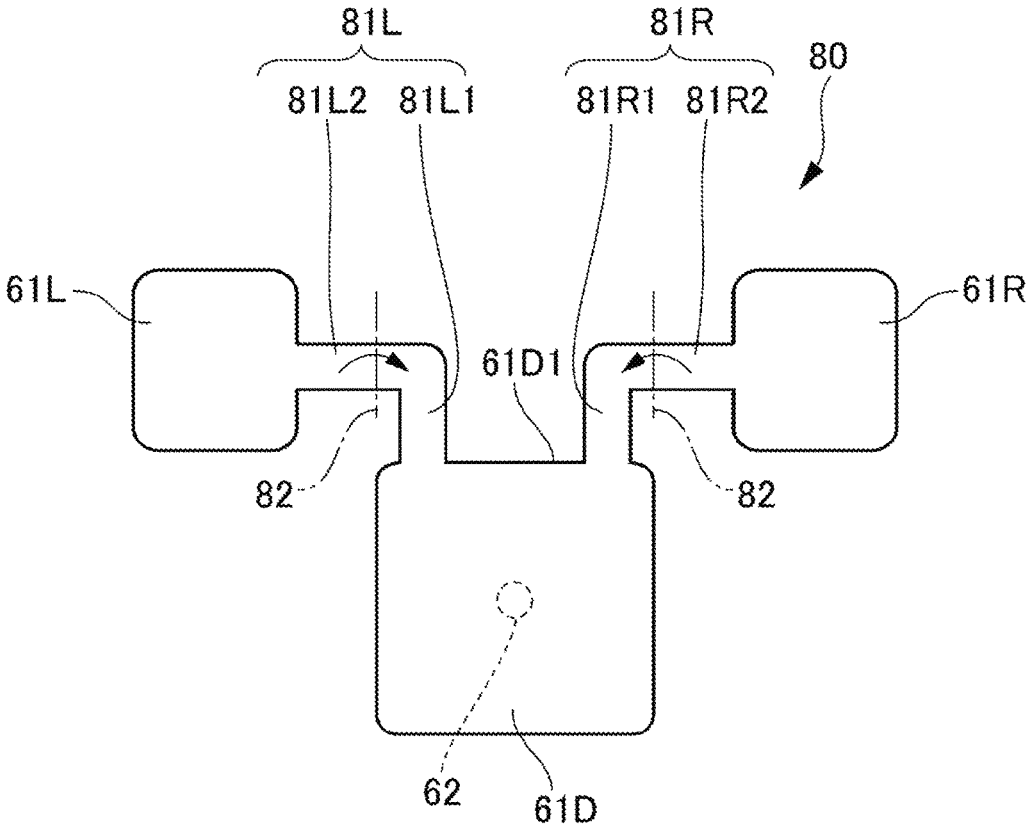
FIG. 8 is a view describing a first variation of the finger holding portion according to the embodiment and a development view of the finger holding portion.

FIG. 8 is a view for describing the first variation of the finger holding portion and illustrates the finger holding portion developed entirely in a flat state. As illustrated in FIG. 8, for example, in the first variation, an integrated-type finger holding portion 80 is formed by which the left-side finger pressing portion 61L and the right-side finger pressing portion 61R are connected to the end 61D1 on a depth side of the lower-side finger pressing portion 61D via connection portions 81L and 81R (fluid passages). Further, the fluid supply/discharge portion 62 for supplying and discharging fluid is provided just to the lower-side finger pressing portion 61D.

The left-side connection portion 81L includes a first portion 81L1 and a second portion 81L2. The first portion 81L1 is formed in a depth direction from a left side of the end 61D1 on a depth side of the lower-side finger pressing portion 61D. The second portion 81L2 is connected to the left-side finger pressing portion 61L by bending at a right angle in a left side direction from the first portion 81L1.

Further, the right side connection portion 81R includes a first portion 81R1 and a second portion 81R2. The first portion 81R1 is formed in a depth direction from a right side of the end 61D1 on a depth side of the lower-side finger pressing portion 61D. The second portion 81R2 is connected to the right-side finger pressing portion 61R by bending at a right angle in a right side direction from the first portion 81L1. Each of the connection portions 81L and 81R include a portion to be bent 82. In the portion to be bent 82, the second portion 81L2 and 81R2 are bent at a right angle, and each of the left-side finger pressing portion 61L and the right-side finger pressing portion 61R is erected.

Figure 9:
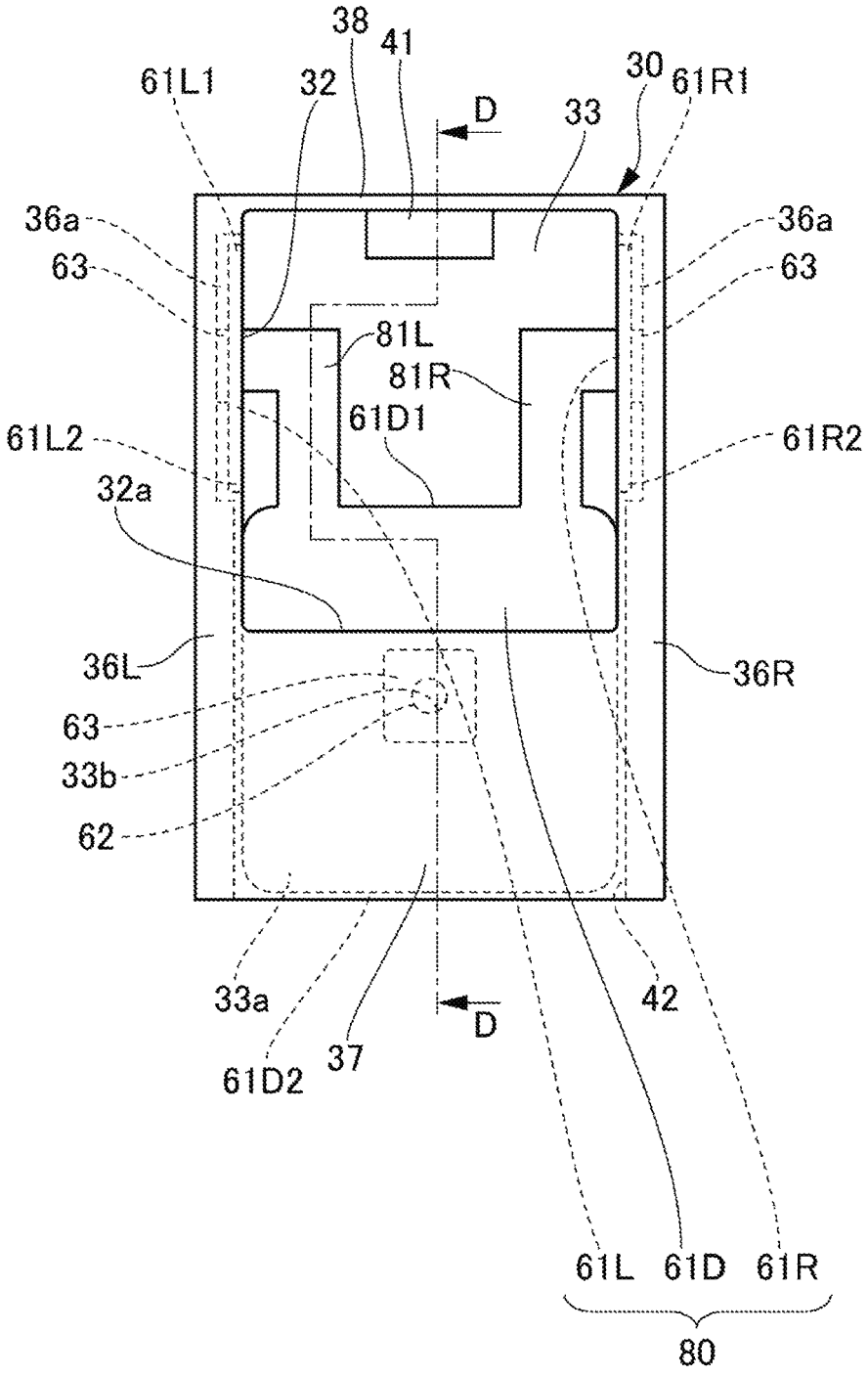
FIG. 9 is a plan view illustrating a structure around the first finger insertion portion including the finger holding portion illustrated in FIG. 8 and a view illustrating a state in which the finger holding portion is shrunk.
Figure 10:
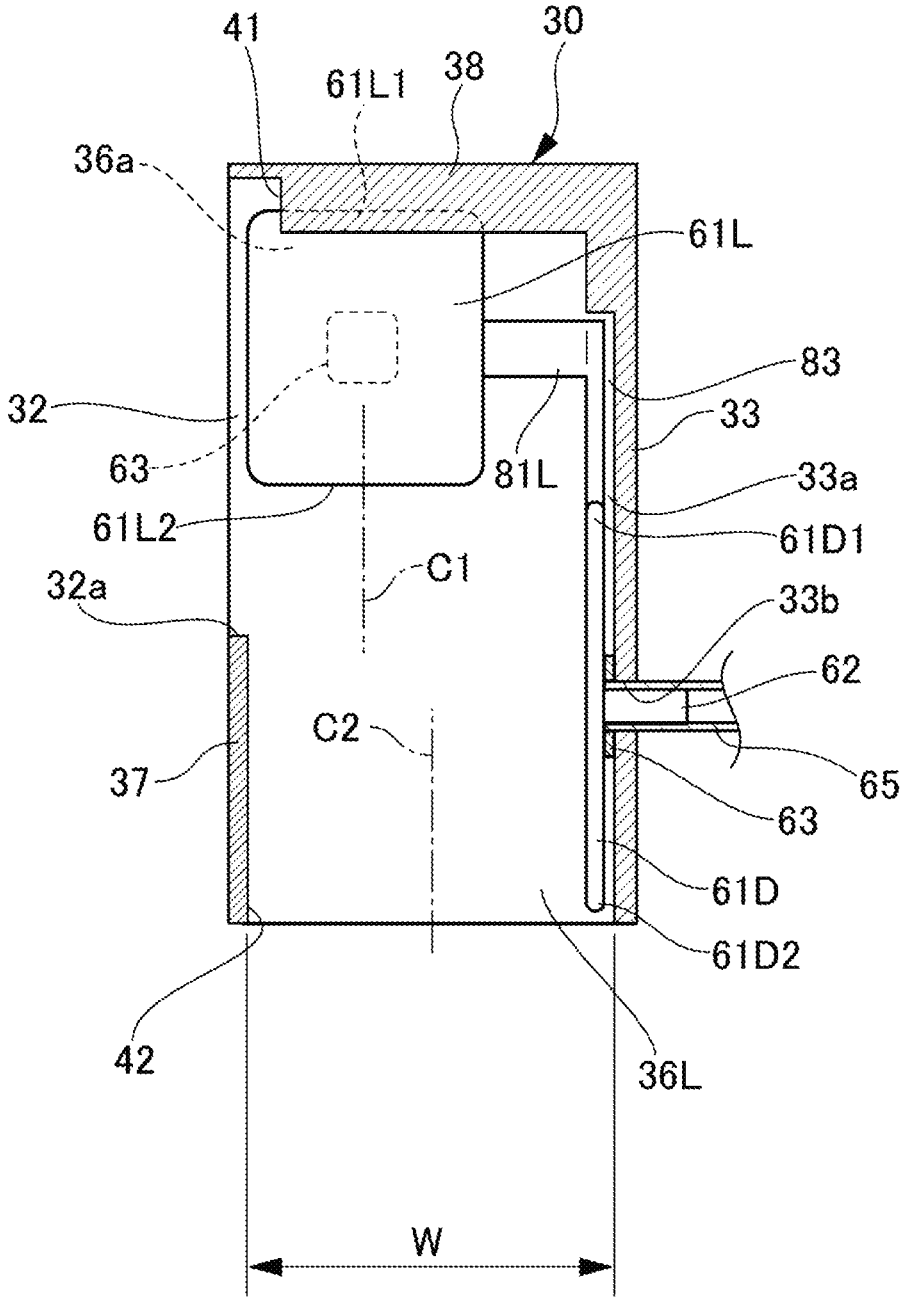
FIG. 10 is a sectional view on D-D line illustrated in FIG. 9.

As illustrated in FIGS. 9 and 10, each of the left-side finger pressing portion 61L and the right-side finger pressing portion 61R erected at a right angle with respect to the lower-side finger pressing portion 61D is stored in the side surface storage unit 36*a*. The lower-side finger pressing portion 61D is stored in the lower-side storage unit 33*a*. Further, each of the connection portions 81L and 81R is stored in a depth side storage unit 83 extending in a further depth side from a depth side end of the lower-side storage unit 33*a*. The lower-side storage unit 33*a*, the left-side finger pressing portion 61L, and the right-side finger pressing portion 61R are fixed on an inner side of the finger holding case 30 by the bonding member 63 (for example a double-side tape) as well as the above-described finger holding portion 60 (refer to FIG. 3).

As illustrated in FIGS. 9 and 10, in the first variation, such as the through hole 36*b* of the side surface storage unit 36*a* illustrated in FIG. 3 can be omitted.

In the first variation, fluid supplied to the lower-side finger pressing portion 61D via the fluid supply/discharge portion 62 is supplied to the left-side finger pressing portion 61L and the right-side finger pressing portion 61R via each of the connection portions 81L and 81R, and accordingly each of the lower-side finger pressing portion 61D, the left-side finger pressing portion 61L, and the right-side finger pressing portion 61R is inflated until reaching to a desired pressure. Vertical and horizontal movement of the finger 12 is suppressed by the lower-side finger pressing portion 61D, the left-side finger pressing portion 61L, and the right-side finger pressing portion 61R, and a nail design is drawn on the nail 11 in a state in which the finger 12 is certainly held. Therefore, the finger holding portion 80 can obtain similar effects to the above-described finger holding portion 60 (refer to FIG. 3).

In addition, in this first variation, the integrated-type finger holding portion 80 is used in which the left-side finger pressing portion 61L and the right-side finger pressing portion 61R are connected to the lower-side finger pressing portion 61D via the connection portions 81L and 81R. Therefore, the lower-side finger pressing portion 61D and the fluid supply/discharge unit 70 are connected by one tube. Consequently, the left-side finger pressing portion 61L and the right-side finger pressing portion 61R do not need a fluid supply/discharge portion, and it is not necessary to connect the left-side finger pressing portion 61L and the right-side finger pressing portion 61R to the fluid supply/discharge unit 70 via a tube. Therefore, assembly is simple, and more inexpensive and compact finger holding portion 80 can be realized.

Next, a second variation of the finger holding portion according to the embodiment will be described with reference to FIGS. 11 and 12.

Figure 11:
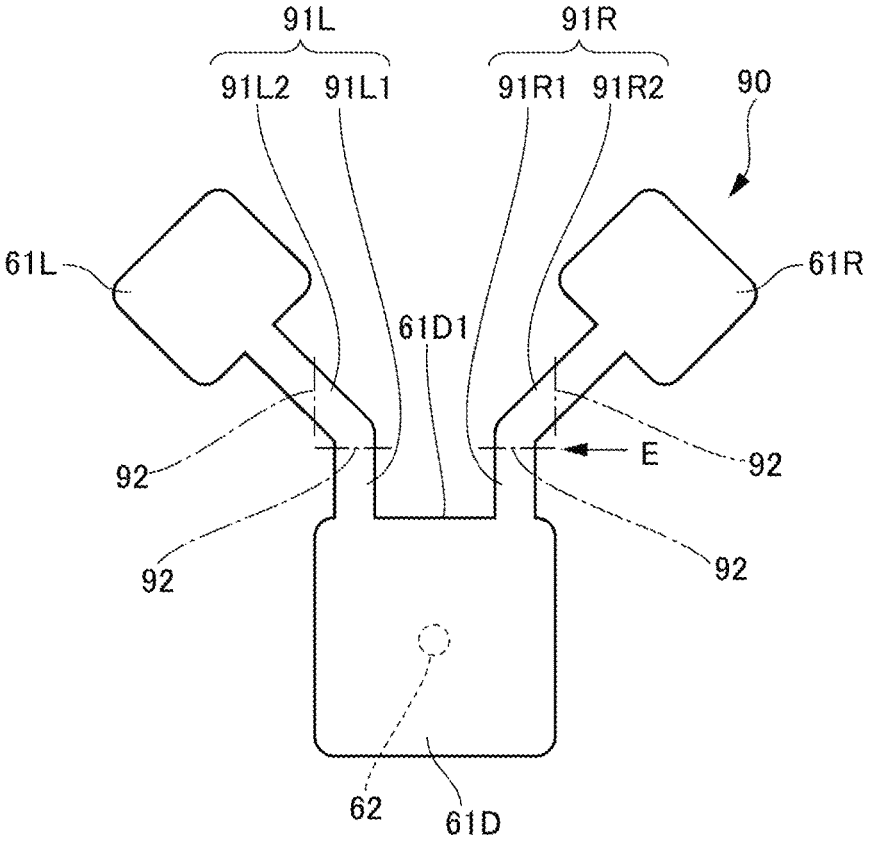
FIG. 11 a view describing a second variation of the finger holding portion according to the embodiment, and a development view of the finger holding portion.
Figure 12:
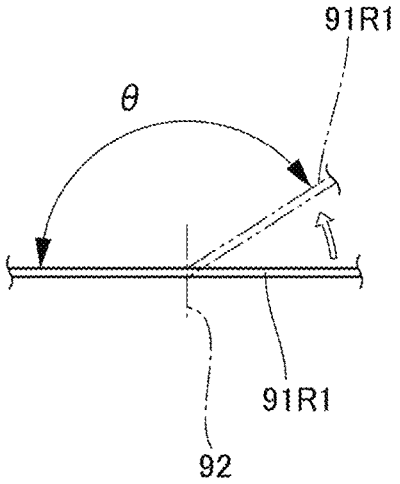
FIG. 12 is a view on an arrow E illustrated in FIG. 11 and a view describing a bending angle at a portion to be bent.

FIG. 11 is a view describing the second variation of the finger holding portion and illustrates the finger holding portion developed entirely in a flat state. As illustrated in FIG. 11, in the second variation as in the above-described first variation, an integrated-type finger holding portion 90 is formed by which the left-side finger pressing portion 61L and the right-side finger pressing portion 61R are connected to the end 61D1 on a depth side of the lower-side finger pressing portion 61D via connection portions 91L and 91R (fluid passages). Further, the fluid supply/discharge portion 62 for supplying and discharging fluid is provided just to the lower-side finger pressing portion 61D.

The left-side connection portion 91L includes a first portion 91L1 and a second portion 91L2. The first portion 91L1 is formed in a depth direction from a left side of the end 61D1 on a depth side of the lower-side finger pressing portion 61D. The second portion 91L2 is connected to the left-side finger pressing portion 61L by bending in an oblique side against an extending direction of the first portion 91L1. Further, the right side connection portion 91R includes a first portion 91R1 and a second portion 91R2. The first portion 91R1 is formed in a depth direction from a right side of the end 61D1 on a depth side of the lower-side finger pressing portion 61D. The second portion 91R2 is connected to the right-side finger pressing portion 61R by bending in an oblique right side against an extending direction of the first portion 91R1.

Each of the connection portions 91L and 91R includes two or more portions to be bent 92 to erect each of the left-side finger pressing portion 61L and the right-side finger pressing portion 61R. In the variation, total two portions to be bent 92 are provided to each of the connection portions 91L and 91R in a middle of the first portions 91L1 and 91R1 and in a middle of the second portions 91L2 and 91R2.

In the finger holding portion 90, the connection portions 91L and 91R are bent twice at the two portions to be bent 92 such that the left-side finger pressing portion 61L and the right-side finger pressing portion 61R are vertically erected with respect to the lower-side finger pressing portion 61D (so as to be disposed on a left surface side and a right surface side on a depth side of the first finger insertion portion 23). In this manner, a bending angle θ1 (refer to FIG. 12) at each portion to be bent 92 becomes gentle. Therefore, when fluid is discharged from the left-side finger pressing portion 61L and the right-side finger pressing portion 61R which are inflated, the fluid pass through the connection portions 91L and 91R bent at a gentle angle.

On the other hand, for example, in the above-described finger holding portion 80 (refer to FIG. 8), a bending angle of the portion to be bent 82 becomes a right angle at the connection portions 81L and 81R, and therefore, fluid may not be easily discharged by passing through the connection portions 81L and 81R depending on a configuration of the finger holding portion 80 and a type of the fluid.

In this point, according to the second variation, fluid passes through the connection portions 91L and 91R bending at a gentle angle, and therefore the fluid can be satisfactory and immediately discharged from the left-side finger pressing portion 61L and the right-side finger pressing portion 61R. A bending angle θ (refer to FIG. 12) of the connection portions 91L and 91R gently bent at the portion to be bent 92 is preferably equal to or greater than 135° (less than 180°).

The preferable embodiment according to the present invention has been described above. However, the present invention is not limited to the specific embodiment, and the invention described in Claims and a scope equivalent thereto are included in the present invention. Hereinafter, the invention described in initial Claims of the application will be appended.

What is claimed is:

1. A finger holder for a drawing device comprising:

an insertion portion into which a finger or a toe including a nail which is a drawing target surface is inserted, the insertion portion comprising a left side wall, a right side wall, a lower wall, an upper wall, and an inner wall joining the left side wall, the right side wall, and the upper and lower walls, the upper wall having an opening configured to expose an entire tip portion of the finger or the toe including a region having the nail of the finger or the toe; and a holding portion disposed in the insertion portion and configured to suppress movement of the finger or the toe, the holding portion comprising:

a first pressing portion disposed on the left side wall near the inner wall and configured to press a first side surface on a first side of the tip portion of the finger or toe that is inserted in the insertion portion;

a second pressing portion disposed on the right side wall near the inner wall and configured to press a second side surface on a second side of the tip portion of the finger or toe that is inserted in the insertion portion; and a third pressing portion disposed on the lower wall and configured to press a lower surface of the finger or toe that is inserted in the insertion portion, wherein each of the first and second pressing portions is disposed at a position such that a distance in a height direction between a center thereof and the opening is shorter than a distance in the height direction between a center of the insertion portion and the opening, and wherein the third pressing portion extends along a proximal portion of the insertion portion, opposite the inner wall, such that a distal end of the third pressing portion is aligned with a proximal portion of the opening.

2. The drawing device according to claim 1, wherein each of the first, second, and third pressing portions has a structure in which the portion is inflated when fluid is supplied, and is shrunk when the supplied fluid is discharged, and wherein when the first, second, and third pressing portions are inflated by the fluid being supplied, the finger or the toe is pressed, and movement of the finger or the toe is suppressed, and when the portions are shrunk by the fluid being discharged, the pressing is released, and the suppression is released.

3. The drawing device according to claim 1, wherein a fluid supply/discharge portion configured to supply and discharge the fluid is provided to one of the first, second, and third pressing portions, and wherein each of the others of the first, second, and third pressing portions is connected to the one of the first, second, and third pressing portions via a respective fluid passage.

4. The drawing device according to claim 3, wherein:

the one of the first, second, and third pressing portions is the third pressing portion, each of the first and second pressing portions is connected to the third pressing portion via the respective fluid passage, and each of the fluid passages has at least one bent portion.

5. The drawing device according to claim 3, wherein:

the one of the first, second, and third pressing portions is the third pressing portion, each of the first and second pressing portions is connected to the third pressing portion via the respective fluid passage, and each of the fluid passages has a plurality of bent portions.

6. The drawing device according to claim 5, wherein a bending angle of each of the plurality of bent portions is equal to or greater than 135°.

7. A method for positioning a finger or toe including a nail by a positioning device included in a drawing device and for performing drawing on the nail by the drawing device, the positioning device comprising an insertion portion into which a finger or a toe including a nail which is a drawing target surface is inserted, the insertion portion comprising a left side wall, a right side wall, a lower wall, an upper wall, and an inner wall joining the left side wall, the right side wall, and the upper and lower side walls, the upper wall having an opening configured to expose an entire tip portion of the finger or the toe including a region having the nail of the finger or the toe, and a holding portion disposed in the insertion portion and configured to suppress movement of the finger or the toe, the holding portion comprising a first pressing portion disposed on the left side wall near the inner wall and configured to press a first side surface on a first side of the tip portion of the finger or toe that is inserted in the insertion portion, a second pressing portion disposed on the right side wall near the inner wall and configured to press a second side surface on a second side of the tip portion of the finger or toe that is inserted in the insertion portion, and a third pressing portion disposed at on the lower wall and configured to press a lower surface of the finger or toe that is inserted in the insertion portion, each of the first and second pressing portions being disposed at a position such that a distance in a height direction between a center thereof and the opening is shorter than a distance in the height direction between a center of the insertion portion and the opening, the third pressing portion extending along a proximal portion of the insertion portion, opposite the inner wall, such that a distal end of the third pressing portion is aligned with a proximal portion of the opening, and the method comprising:

suppressing movement of the finger or the toe by pressing both side surfaces and the lower surface of the finger or the toe that is inserted into the insertion portion by supplying fluid to the first, second, and third pressing portions, to thereby inflate the first, second, and third pressing portions, whereby the tip portion of the finger or the toe, which is pressed upward by the third pressing portion and obliquely downward by the first and second pressing portions, is prevented from passing upward out through the opening;

performing drawing on the nail of the finger or the toe the movement of which is suppressed; and releasing the suppression by releasing the pressing by discharging the fluid from the first, second, and third pressing portions after performing the drawing, whereby the first and second pressing portions are shrunk.

8. The control method for the drawing device according to claim 7, wherein a fluid supply/discharge portion configured to supply and discharge the fluid is provided to one of the first, second, and third pressing portions, and wherein each of the others of the first, second, and third pressing portions is connected to the one of the first, second, and third pressing portions via a respective fluid passage.

9. The control method for the drawing device according to claim 8, wherein:

the one of the first, second, and third pressing portions is the third pressing portion, each of the first and second pressing portions is connected to the third pressing portion via the respective fluid passage, and each of the fluid passages has at least one bent portion.

10. The control method for the drawing device according to claim 8, wherein:

the one of the first, second, and third pressing portions is the third pressing portion, each of the first and second pressing portions is connected to the third pressing portion via the respective fluid passage, and each of the fluid passages has a plurality of bent portions.

11. The control method for the drawing device according to claim 10, wherein a bending angle of each of the plurality of bent portions is equal to or greater than 135°.

* * * * *